US005271753A

United States Patent [19]

Akel et al.

[11] Patent Number: 5,271,753

[45] Date of Patent: Dec. 21, 1993

[54] STEAM DRYING APPARATUS

[75] Inventors: H. Rodolfo Akel, Suffield; Bard C. Teigen, Enfield; Gary W. Gralton, East Granby; Peter Acimovic, Madison, all of Conn.

[73] Assignee: Combustion Engineering, Inc., Windsor, Conn.

[21] Appl. No.: 997,901

[22] Filed: Dec. 29, 1992

[51] Int. Cl.[5] ..... B01D 53/26

[52] U.S. Cl. ..... 55/436; 55/DIG. 23; 55/440

[58] Field of Search ..... 55/DIG. 23, 440, 442, 55/443, 444, 436

[56] References Cited

U.S. PATENT DOCUMENTS

| | | | |
|---|---|---|---|
| 2,463,382 | 3/1949 | Hobbs | 55/440 |
| 2,532,332 | 12/1950 | Rowand | 55/444 |
| 2,715,451 | 8/1955 | Raynor | 55/440 |
| 2,993,565 | 7/1961 | Coulter . | |
| 3,008,538 | 11/1961 | Glasgow | 55/440 |
| 3,165,387 | 1/1965 | Place . | |
| 4,045,193 | 8/1977 | Halliday | 55/436 |
| 4,182,277 | 1/1980 | Burton et al. . | |
| 4,483,696 | 11/1984 | Zipay et al. . | |
| 4,565,554 | 1/1986 | Zipay et al. | 55/440 |
| 5,049,171 | 9/1991 | Presnell et al. | 55/DIG. 23 |

OTHER PUBLICATIONS

Singer, Joseph G.; Combustion-Fossil Power Systems, Combustion Engineering, Inc., 1981, pp. 5-24 to 5-31, 7-14 to 7-16 and 8-9.

*Primary Examiner*—Tim Miles

*Attorney, Agent, or Firm*—Chilton, Alix & Van Kirk

[57] ABSTRACT

A liquid-vapor separating drum has a screen dryer mounted in the upper portion between the primary separators and the vapor outlet. The screen dryer is constructed and mounted in such a way that only minimal access is required in the space above the screen dryer whereby the space can be minimized. A central pair of dryer rows is installed first when there is easy access. The two outside rows are then merely clipped in place which does not require any access. The bottoms of the rows are joined by drain panels which form a flow barrier and which serve to collect the liquid extracted by the screens. Hanging rods are used to support these drain panels and thereby indirectly support the bottoms of the rows. Vortex breakers in drain apertures of the drain panels improve the drainage rate.

8 Claims, 4 Drawing Sheets

STEAM DRYING APPARATUS

BACKGROUND OF THE INVENTION

This invention relates to the field of separating vapors from liquids in many two-phase mixtures such as separating steam from water in a boiler or other two-phase mixtures such as natural gas and hydrocarbons. More particularly, the invention relates to steam drum internals for separating and drying steam.

Steam generated in a subcritical pressure drum type boiler is intimately mixed with large and variable amounts of circulating boiler water. Before the steam leaves the boiler and enters the superheater, practically all of this associated boiler water must be separated from the steam. This separation must be done within a limited space in the steam drum, within a matter of seconds and under a variety of velocity, pressure and other operating condition. The pressure drop across the steam and water separators must be kept to a minimum so as not to affect the boiler circulation or water level controls. Despite many theoretical analyses of steam and water separation and a great number of hypotheses to explain these phenomena, steam and water separation in boilers retains many aspects of an art and has thus far defied complete mathematical representation.

Nearly all of the liquid and solid impurities in the steam and water mixture must be separated from the steam before it is suitable for use. Any unseparated liquid in the steam contains dissolved and suspended salts which appear as a solids impurity in the steam when the moisture is evaporated in the superheater or it is directed to a turbine or other steam driven apparatus.

The drum of a subcritical pressure boiler serves several functions, the first being that of collecting the mixture of water and steam discharged from the boiler circuits. Also, the drum houses equipment to separate the steam from the water and then purify the steam after it has been separated. The drum internals in subcritical pressure boilers not only separate water from steam but also direct the flow of water and steam to establish an optimum distribution of fluids in the boiler during all loads of boiler operation. The internals may consist of baffles which change the direction of flow of a steam and water mixture, impellers and separators which use a spinning action for removing water from steam or moisture coalescevs such as screen and corrugated plate final dryers. These devices are used singly or in consort to separate and purify the steam and remove impurities from the steam leaving the boiler drum.

The space required to accommodate steam separating and purifying equipment determines drum size. Drum diameter and length should be sufficient to provide accessibility for installation and inspection and for processing the maximum flows of water and steam. Providing sufficient drum diameter and length to provide this accessibility while still maintaining a drum of a reasonable size is a significant challenge to the designer of drum internals.

SUMMARY OF THE INVENTION

It is therefore an object of the present invention to provide a vapor separating apparatus which will afford efficient and effective separation and drying within a minimum space and with a relatively low pressure loss. More particularly, the present invention relates to a compact steam final dryer having a support assembly which permits installation of the dryer assembly requiring only very limited access to the confined region above the assembly between the assembly and the drum exit.

DESCRIPTION OF THE PREFERRED EMBODIMENT

Although the invention is applicable to the separation of various liquid-vapor mixtures as previously stated, the invention will be described with particular reference to steam drums and the separation of water and steam.

Figure 1:
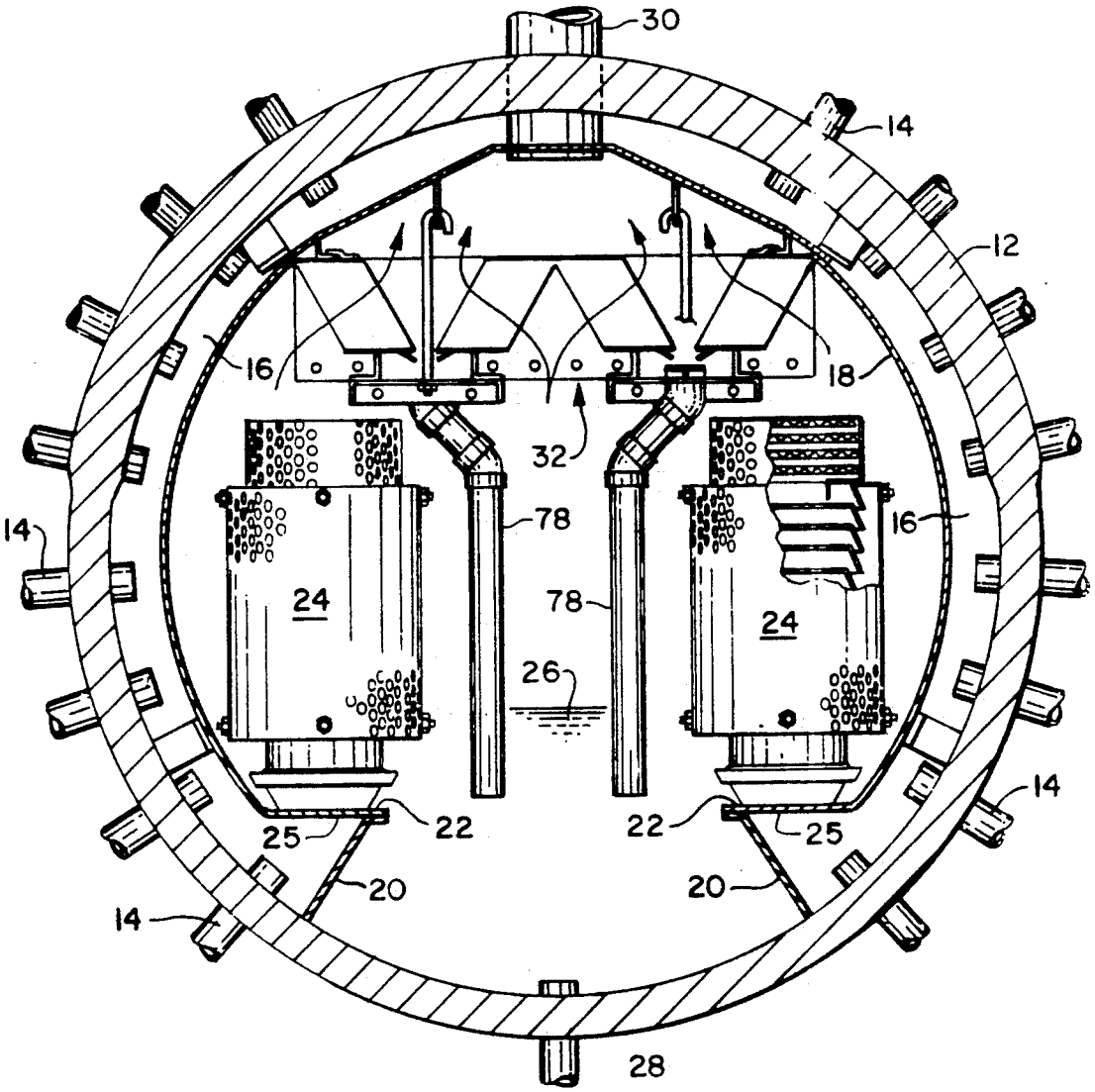
FIG. 1 is a vertical cross-sectional view of a steam drum incorporating the steam dryer of the present invention.

Referring specifically to FIG. 1 of the drawings, the drum 12 is the conventional steam drum configuration with an elongated cylindrical shape and disposed with its axis parallel to the horizontal. The drum 12 is penetrated by riser pipes 14 which receive the steam/water mixture from the steam generator and discharge this mixture into the annular space 16 between the drum liner or baffle 18 and the drum 12. Although the riser pipes 14 have been illustrated as being distributed rather uniformly around the annular space 16, the actual sections of the drum penetrated by the risers is a variable that depends on the drum operating pressure, the type of furnace circulation and the mass loading of steam and water into the drum. The baffle 18 is closed off at the bottom ends by the baffle portions 20 and the baffle includes the horizontal ledge portions 22. This baffle 18 including its portions 20 and 22 extends the full length of the drum thereby providing the enclosed annular space 16.

Mounted on the baffle ledge portions 22 are a plurality of steam separating units 24 in two horizontally extending rows on either side of the axis of the drum. Although two rows have been illustrated, there may be more than two. Each row would contain as many separators as desired and would be dependent on the drum size and capacity. The steam separators 24 are mounted over apertures 25 in the baffle ledge portions 22 thereby directing the flow of the steam-water mixture from the pipes 14 into the annular space 16 and then up through the apertures 25 in the baffle ledge portions 22 and into the interior of the separators 24.

The design details of the steam separators 24 do not constitute a part of the present invention and have not been fully shown. Suffice it to say that the steam separators 24 for purposes of the present invention may be of any conventional design which performs the primary separation of the steam and water and permits the water to drain down from the separators 24 into the pool of water 26 in the bottom of the steam drum. The water then exits the steam drum through the downcomer 28 and is returned to the steam generator. The steam drum would also contain other conventional components which are not shown such as means for providing make-up water, means for introducing chemicals and means for blow-down operation.

The steam which has undergone primary separation from the water in the separators 24 rises through the vapor space in the steam drum towards the steam outlet 30. Located in the vapor space between the separators 24 and the outlet 30 is the final dryer assembly generally indicated as 32. It is the design, arrangement and mounting of this final dryer assembly 32 which constitutes the present invention.

Figure 2:
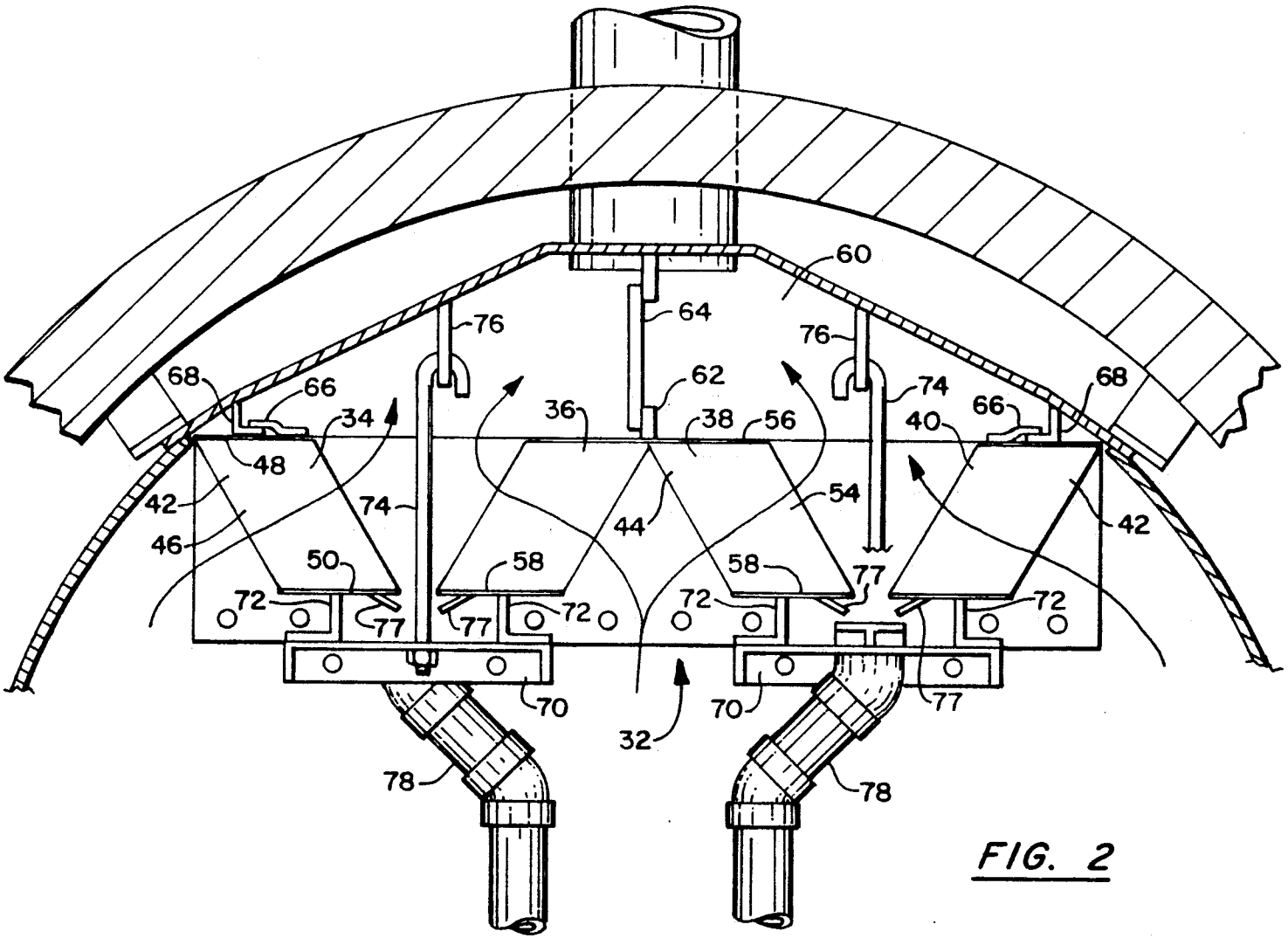
FIG. 2 is an enlarged view of the top portion of the drum of FIG. 1.

The flow of the steam through the final dryer assembly is generally shown by the arrows in FIG. 1. The details of the final dryer assembly can be better seen in FIG. 2 which is an enlarged view of the top portion of the drum of FIG. 1.

Figure 4:
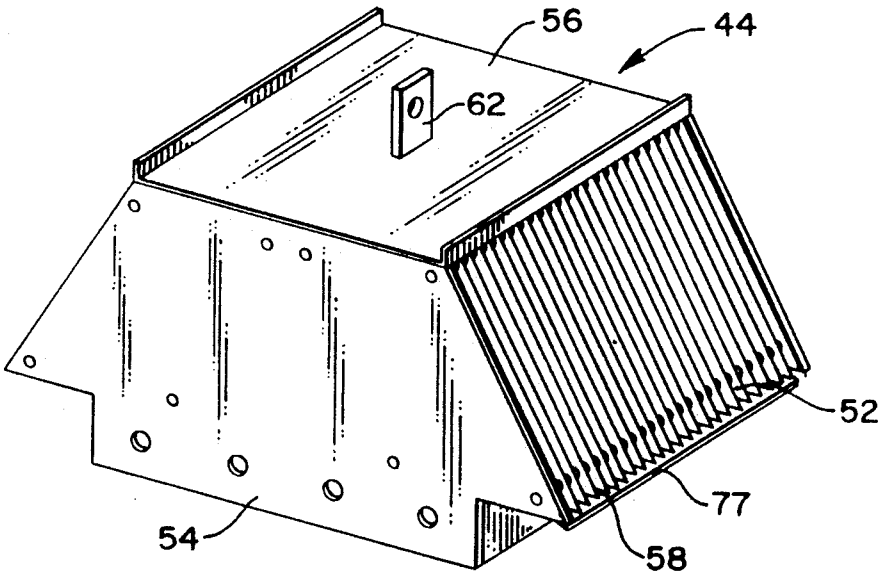
FIG. 4 is a perspective view of one of the center steam dryer sections.
Figure 3:
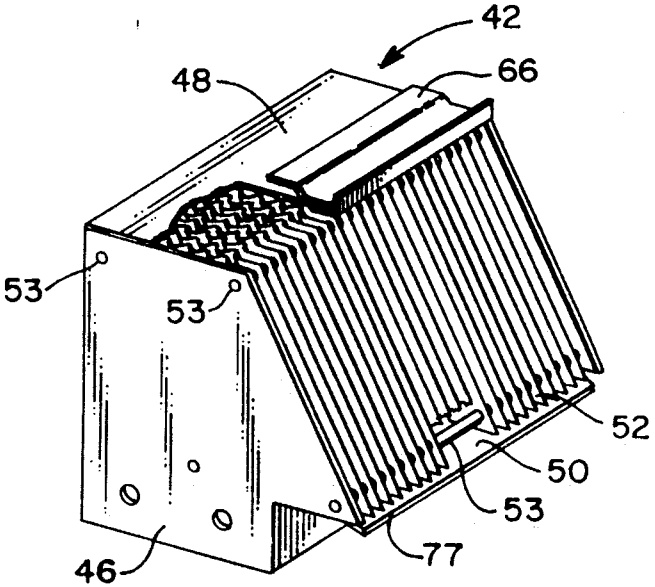
FIG. 3 is a perspective view of one of the outside steam dryer sections.

The final dryer assembly comprises four dryer rows, 34, 36, 38 and 40 with each row extending substantially the length of the steam drum. Rows 34 and 40 are each formed from a plurality of dryer modules 42 as shown in perspective in FIG. 3. The rows 36 and 38 are formed together as a plurality of modules 44 as shown in FIG. 4.

Each of the modules 42 is formed from two end plates 46, a top plate 48 and a bottom plate 50. Mounted between the end plates 46 and extending from the top plate 48 to the bottom plate 50 are the corrugated plates 52 which provide a tortuous path through the dryer for the steam flow. These plates 52 are conventional corrugated dryer plates which have crimps in the corrugations near the four corners to prevent nesting and maintain the proper flow passages. They are mounted on the rods 53 which are welded to the two end plates 46 to form the module. These plates 52 cause any water droplets to impinge on the corrugations where they are collected and drain down.

Each of the modules 44 is formed from two end plates 54, a top plate 56 and a pair of bottom plates 58. Mounted between the end plates 54 and extending from the top plate 56 to each of the bottom plates 58 are the same corrugated plates 52 thus forming the inverted V-shaped configuration between the rows 36 and 38.

Figure 5:
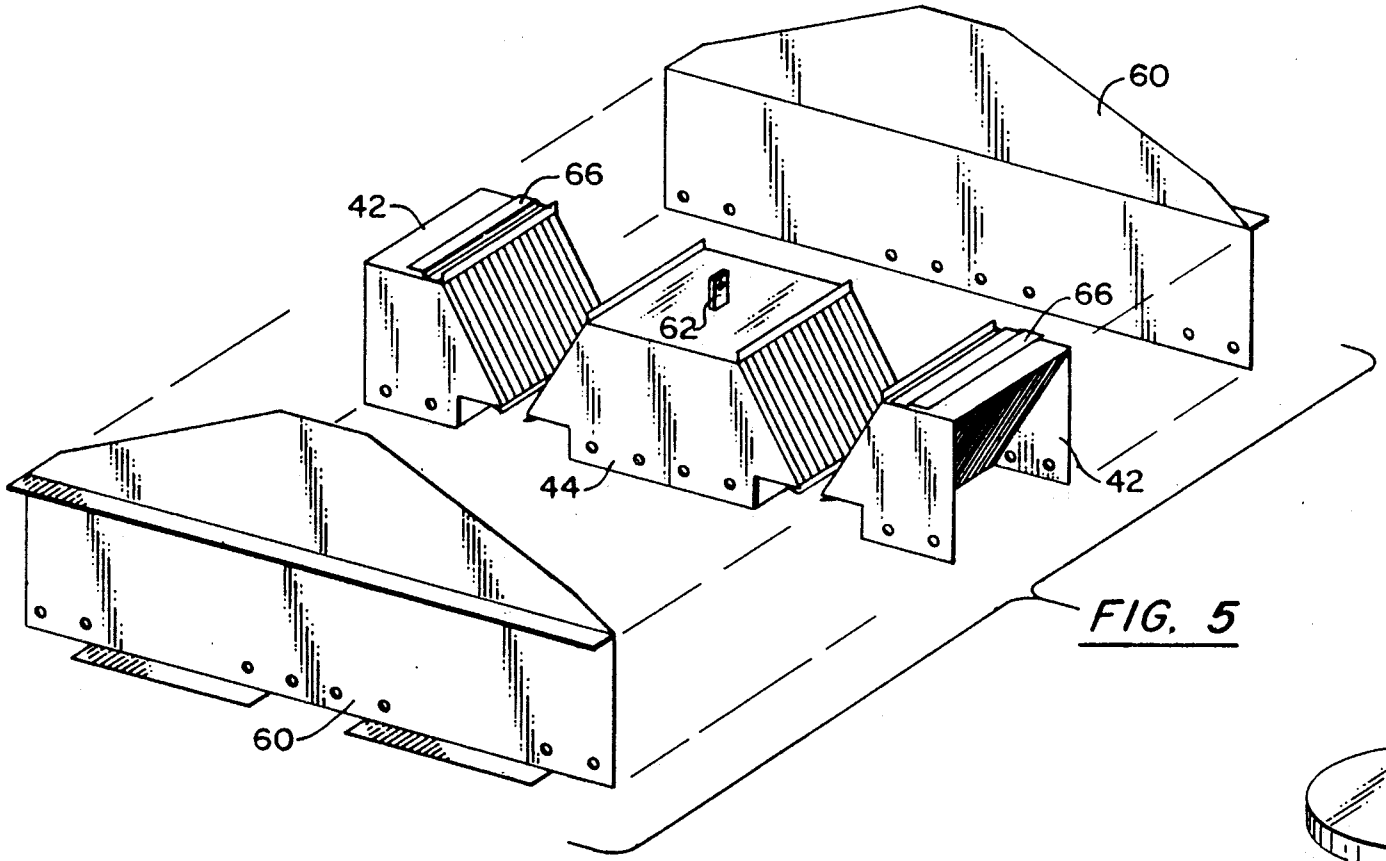
FIG. 5 is an exploded perspective view showing steam dryer sections in relation to each other and to the end plates.

In each row, the required number of modules are attached together by means of welding or bolting to form the desired length for the particular steam drum size. The modules are mounted between the end panels 60 shown in FIGS. 2 and 5.

The modules 44 are installed first, i.e. before the modules 42. On the top of the modules 44 are brackets 62 welded to the top plates 56. In turn, these brackets are attached to the brackets 64 again such as by welding or bolting. Since the modules 42 in rows 34 and 40 have not yet been installed, there is easy access to the space above the modules 36 and 38 to weld or otherwise attach the brackets 62 to the brackets 64.

The modules 42 have mounted on the top thereof the clips 66 which run the length of each module. Mounted on the steam drum, or more accurately on the baffle 18, are L-shaped brackets 68 which run the full length of the steam drum or at least the full length of each row of modules. The clips 66 are adapted to fit over the brackets 68 to support the tops of the modules 42 and to form a seal between the tops of the modules and the space below the modules. Once the center modules 44 have been installed, the modules 42 can then be easily clipped in place without the need for access to the space above the dryer.

Attached to the bottom of the pair of rows 34 and 36 and to the bottom of the pair of rows 38 and 40 are drain panels 70. These drain panels 70 are attached by means of the brackets 72 on the bottom of each row of the modules. These brackets 72 extend the full length of each module and are welded to plates 50 and 46 or plates 58 and 54 to form seals between the modules and the drain panels such that the steam flow is forced to go through the steam dryer modules rather than around the outside.

In order to provide adequate support for the drain panels 70 and for the bottoms of the modules which are attached to the drain panels, J-rods 74 or equivalent eye bolts are provided. These J-rods or eye bolts are spaced at desired intervals along the length of the modules. The J-rods are hooked into openings in the corresponding brackets 76 attached to the baffle openings in 18. The eye bolts would be attached over appropriate hooks on the brackets 76. These J-rods or eye bolts are hooked or attached to the brackets 76 prior to installation of the drain panels 70. Therefore, once again, no access problems exist. The lower ends of the J-rods or eye bolts 74 protrude through holes in the drain panels 70 and then nuts are threaded onto the J-rods or eye bolts to support the drain panels on the J-rods or eye bolts.

Figure 6:
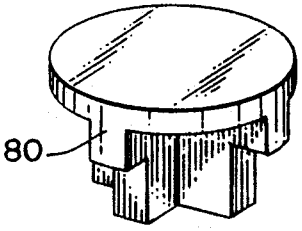
FIG. 6 is an isometric view of a vortex breaker used in the present invention.

Located on the edges of the bottom plates 50 and 58 are drip lips 77 which facilitate the drainage of water from the bottom plates into the drain panels 70. From the drain panels 70, the water drains into and through the drain pipes 78 down into the pool of water 26 in the bottom of the steam drum. Inserted into the drain pipes 78 are the vortex breakers 80 which are shown isometrically in FIG. 6. These smooth out and aid the flow of liquid into the drain pipes 78 by breaking up the vortex and preventing the buildup of water.

It can be seen that the screen dryer is readily installed without the need for any great degree of access to the space above the screen dryer. Once the brackets 62 and 64 are welded together, which can be readily done because rows 34 and 40 have not yet been installed, there is no longer any need for access inside the top space. This means that the space can be made small thereby conserving space and allowing the overall steam drum to be smaller in diameter.

We claim:

1. A liquid-vapor separating apparatus comprising a horizontally oriented cylindrical drum having inlet means for receiving a mixture of liquid and vapor, liquid outlet means disposed in the lower portion of said drum for discharging separated liquid, vapor outlet means in the upper portion of said drum for discharging separated vapor, separating means disposed in the lower portion of said drum for separating some of said liquid from said mixture and providing a partially dried mixture, and a screen dryer disposed in the upper portion of said drum between said separating means and said vapor outlet to provide a dried vapor, said screen drier comprising:

a. four rows of screen dryer units oriented such that said partially dried mixture passes through said screen dryer units before exiting through said vapor outlet means to remove entrained liquid therefrom including a pair of center rows of screen dryer units spaced from each other and extending generally along and adjacent the vertical center line of said drum and a pair of outer rows of screen dryer units extending along each side of said drum and space outwardly from said center rows;

b. means joining the tops of said center rows to prevent vapor flow therebetween and to force vapor flow from the center line outwardly through said pair of center rows of screen dryer units;

c. means attached to said pair of center rows of screen dryer units and attached to said drum either directly or indirectly to suspend said pair of center rows of screen dryer units;

d. clip and bracket means attached to the tops of said outer rows and either directly or indirectly to said drum said clip adapted to be clipped onto said bracket to hold the tops of said outer rows in position with respect to said drum and to form a vapor flow seal between the tops of said outer rows and said drum to prevent vapor flow therebetween and to force vapor flow from the sides inwardly through said outer rows;

e. means joining the bottoms of said outer rows to the bottoms of the adjacent one of said center rows to seal the space between said outer rows and said adjacent center row to prevent vapor flow therebetween and thereby force vapor flow through said screen dryer units, said means joining the bottoms of said rows forming drainage means adapted to collect liquid separated in said screen dryer units including means for conducting said collected liquid to the bottom of said drum; and f. means operable from below said drainage means for suspending said drainage means either directly or indirectly from said drum.

2. Liquid-vapor separating apparatus as recited in claim 1 wherein each of said dryer units of said pair of outer rows of dryer units comprises:

a. an outer row top plate;

b. an outer row bottom plate;

c. outer row end plates on each end joining said outer row top and bottom plates;

d. a plurality of spaced corrugated dryer plates extending vertically between said outer row top and bottom plates and spaced between said outer row end plates thereby forming a tortuous flow path between adjacent plates and through said unit for the partially dried mixture.

3. Liquid-vapor separating apparatus as recited in claim 2 wherein said bottom plate includes a downturned drip lip to direct separated liquid from said bottom plate into said means joining said bottoms.

4. Liquid-vapor separating apparatus as recited in claim 2 wherein each of said dryer units of said pair of center rows of dryer units comprises:

a. a center row top plate comprising said means joining said tops of said center rows;

b. a pair of spaced apart center row bottom plates adapted to permit flow of partially dried mixture therebetween;

c. center row end plates on each end joining said center row top plate to said pair of center row bottom plates; and d. a first plurality of spaced corrugated dryer plates extending vertically between said center row top plate and one of said pair of center row bottom plates and a second plurality of spaced corrugated dryer plates extending vertically between said center row top plate and the other of said pair of center row bottom plates, said first and second plurality of corrugated dryer plates being spaced between said center row end plates thereby forming first and second tortuous flow paths between adjacent plates and through both of said pair of center rows of dryer units.

5. Liquid-vapor separating apparatus as recited in claim 4 wherein said means attached to said pair of center rows to suspend said pair of center rows comprises means attaching said center row top plate to said drum.

6. Liquid-vapor separating apparatus as recited in claim 1 wherein said means operable from below said drainage means for suspending said drainage means comprises:

a. bracket means attached directly or indirectly to said drum including means for hooking a rod onto said bracket means;

b. a rod having means on one end adapted to be hooked to said means for hooking on said bracket means and means on the other end adapted to suspend said drainage means from said rod.

7. Liquid-vapor separating apparatus as recited in claim 1 and further including means associated with said means for conducting said collected liquid to the bottom of said drum to prevent the formation of vortices.

8. Liquid-vapor separating apparatus as recited in claim 7 wherein said means for conducting said collected liquid to the bottom of said drum comprises drain apertures in said means joining the bottoms of said outer rows to the bottoms of the adjacent one of said center rows and wherein said means to prevent the formation of vortices comprises vortex breakers installed in said drain apertures to aid in the flow of said collected liquid into said means for conducting said collected liquid to the bottom of said drum.

* * * * *